United States Patent [19]

Priegel

[11] 3,955,545

[45] May 11, 1976

[54] POST CARBURETOR ATOMIZER

[75] Inventor: Jack C. Priegel, El Paso, Tex.

[73] Assignee: Autotronic Controls Corporation, El Paso, Tex.

[22] Filed: June 25, 1974

[21] Appl. No.: 483,056

[52] U.S. Cl. ..... 123/119 E; 123/141; 123/198 E; 261/1; 261/34 A; 261/50 R; 261/DIG. 48; 239/102

[51] Int. Cl.[2] ..... F02M 27/08

[58] Field of Search ..... 123/119 E, 141, 198 E; 261/DIG. 48, 1, 34 A, 50 R, 69 R; 340/10; 239/102

[56] References Cited

UNITED STATES PATENTS

| | | | |
|---|---|---|---|
| 1,939,302 | 12/1933 | Heaney | 261/DIG. 48 |
| 2,163,649 | 6/1939 | Weaver | 261/DIG. 48 |
| 2,414,494 | 1/1947 | Vang | 123/119 E |
| 2,414,494 | 1/1947 | Vang | 123/119 E |
| 2,453,595 | 11/1948 | Rosenthal | 261/DIG. 48 |
| 2,454,900 | 11/1948 | Vang | 123/119 E |
| 2,791,990 | 5/1957 | Grieb | 261/DIG. 48 |
| 3,016,233 | 1/1962 | Olmstead | 261/DIG. 48 |
| 3,533,606 | 10/1970 | Thatcher | 123/119 E |
| 3,756,575 | 9/1973 | Cottell | 261/1 |

FOREIGN PATENTS OR APPLICATIONS

| | | | |
|---|---|---|---|
| 1,246,580 | 10/1960 | France | 123/119 E |
| 723,797 | 2/1955 | United Kingdom | 261/DIG. 48 |

*Primary Examiner*—Wendell E. Burns
*Attorney, Agent, or Firm*—Marcus L. Bates

[57] ABSTRACT

An ultrasonic fuel atomizer which is inserted between a standard carburetor and intake manifold of an internal combustion engine to cause a more uniform mixture of fuel and air to be attained, thereby promoting fuel economy and increasing the efficiency of combustion.

The apparatus driver a vibrating plate assembly which is excited by a driven such as a piezo electrical crystal. Within the housing of the apparatus there is formed a cavity through which fuel and air must travel along a prescribed path which causes large droplets of fuel to impinge upon the vibrating plate, thereby drastically reducing the droplet size of the fuel.

10 Claims, 9 Drawing Figures

POST CARBURETOR ATOMIZER

BACKGROUND OF THE INVENTION

Atomization of combustion fuel into small droplets produces a mist which can be more uniformly mixed with combustion air. The resultant uniform fuel and air mixture improves the efficiency of engine operation because the small fuel droplets tend to travel with the air flow, thereby minimizing wetout, while at the same time the liquid surface area of the mass fuel flow is increased, thereby allowing much faster and more complete vaporization of the fuel.

Atomization of liquid fuel beyond the amount realized by utilization of a standard carburetor enables easier starting, leaner and shorter duration of choke settings, satisfactory cold drive-aways, with these attributes being attained with lean mixture settings. Where the combustion fuel is properly atomized, the correct combustion air-fuel mixture is quickly achieved upon initial cranking of the engine. Improved atomization enables leaner mixtures to be utilized because the improved mixture promotes more complete combustion of the fuel and air, whereas non-homogenous fuel and air mixtures cause erratic combustion of the reactants which in turn cause increased objectionable exhaust emissions.

SUMMARY OF THE INVENTION

A post carburetor atomizer in the form of an ultrasonic fuel atomizer which can be inserted between a standard carburetor and intake manifold of an internal combustion engine of an automobile, for example.

The apparatus comprises a disk affixed to an exciter with the exciter being connected to electrical circuitry so that energization of the circuitry causes the exciter to drive the disk at the resonant frequency of the entire system. The disk and exciter are housed within a chamber with the disk being disposed laterally respective to air flow from the carburetor. Large droplets of fuel deposit as a film on the surface of the disk, whereupon the vibrational energy drives the liquid film therefrom to thereby produce an extremely fine mist.

The novel arrangement of the various components of the atomizer makes possible its incorporation into existing systems by merely interposing the atomizer apparatus between the carburetor and intake manifold.

Accordingly, a primary object of this invention is the provision of a post carburetor atomizer apparatus for use in combination with an internal combustion engine.

Another object of the invention is to provide improvements in atomization of fuel/air mixtures.

A further object of this invention is to disclose and provide an atomizer apparatus having a very small pressure drop thereacross.

A still further object of this invention is to provide atomizer apparatus which can be interposed between the intake manifold and carburetor of an internal combustion engine and which promotes vaporization of the droplets of fuel in an air/fuel mixture.

Another and still further object is to provide improvements by which the efficiency of combustion in an internal combustion engine is increased by the provision of post carburetor atomizer apparatus which cooperates with the internal combustion engine in a new and unexpected manner.

An additional object is to provide a combination of elements which includes circuitry, an exciter, a vibrating element, and a housing for use in conjunction with a carburetor of an internal combustion engine.

These and various other objects and advantages of the invention will become readily apparent to those skilled in the art upon reading the following detailed descriptions and claims and by referring to the accompanying drawings.

The above objects are attained in accordance with the present invention by the provision of a combination of elements which are fabricated in a manner substantially as described in the above abstract and summary.

DETAILED DESCRIPTION OF THE PREFERRED EMBODIMENTS

Figure 1:
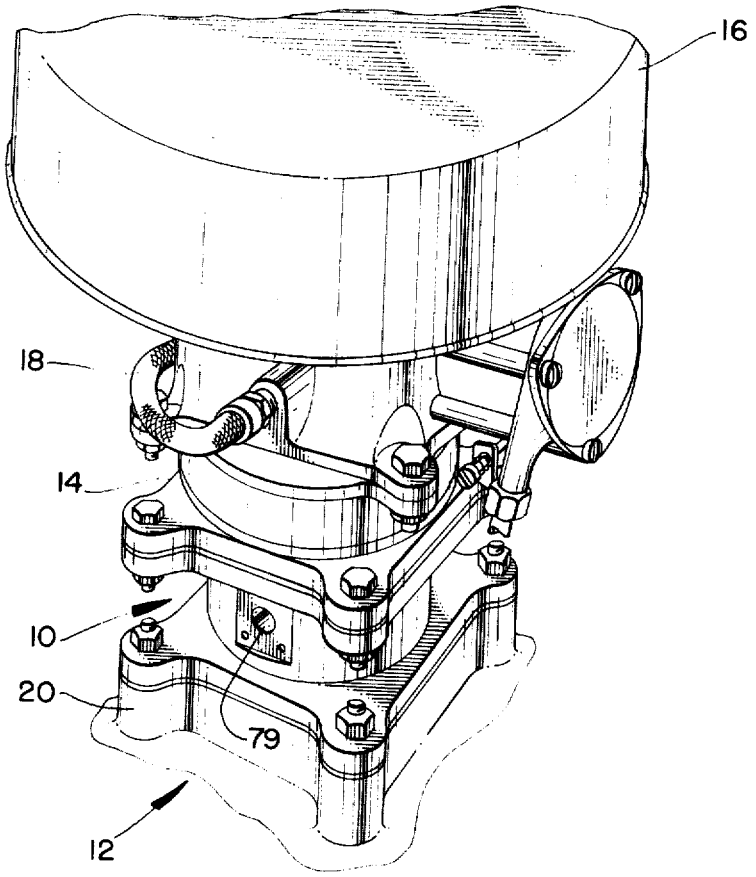
FIG. 1 is a fragmentary, perspective view of one form of the present invention illustrated in combination with an internal combustion engine.

In FIG. 1 there is disclosed a post carburetor atomizer apparatus 10 made in accordance with the present invention. The apparatus is operatively disposed relative to an internal combustion engine 12 having a standard carburetor 14 thereon, with the carburetor including the usual air intake 16 and fuel inlet 18. The atomizer apparatus is interposed between the carburetor and the intake manifold 20 by utilizing the existing illustrated mating flanges.

Figure 2:
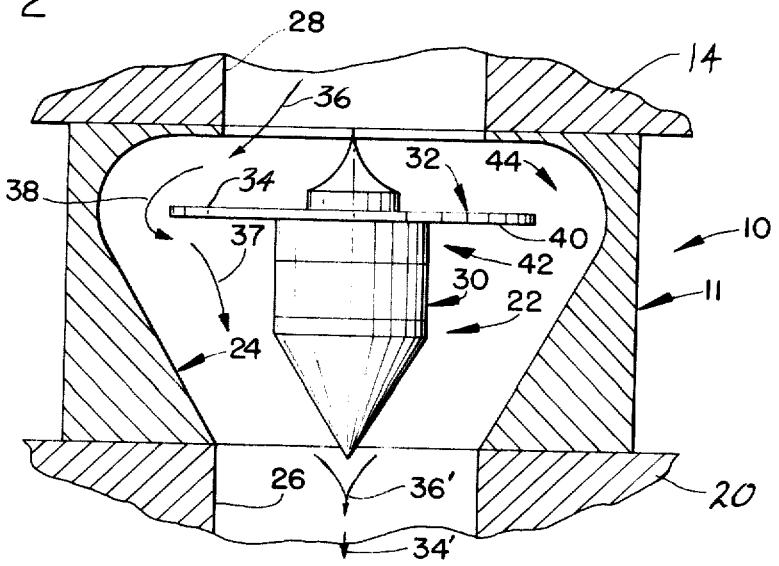
FIG. 2 is a fragmentary, part cross-sectional, part diagrammatical illustration showing a simplified form of the present invention.

In FIG. 2 the housing 11 of the atomizer apparatus is schematically illustrated as being positioned in interposed relationship between the carburetor and the intake manifold. An atomizer 22 is axially aligned and centrally positioned relative to a curved circumferentially disposed chamber 24, which also forms the interial peripherial wall surface of the housing. Inlet 28 and outlet 26 communicate with one another by means of the chamber, and provide for the flow of fuel and air into the combustion chambers of the internal combustion engine.

A driver or exciter 30 vibrates a plate member in the form of a metallic or non-metallic disk 32 at a predetermined resonant frequency. The disk has a peripheral edge 34. Fuel and air flowing through the system assumes the flow path indicated by the arrows at 36, 37, and 38. The location of the downstream side 40 of the disk respective to the chamber and the exciter body cooperate together to form a high velocity or high turbulent zone 44.

Figure 3:
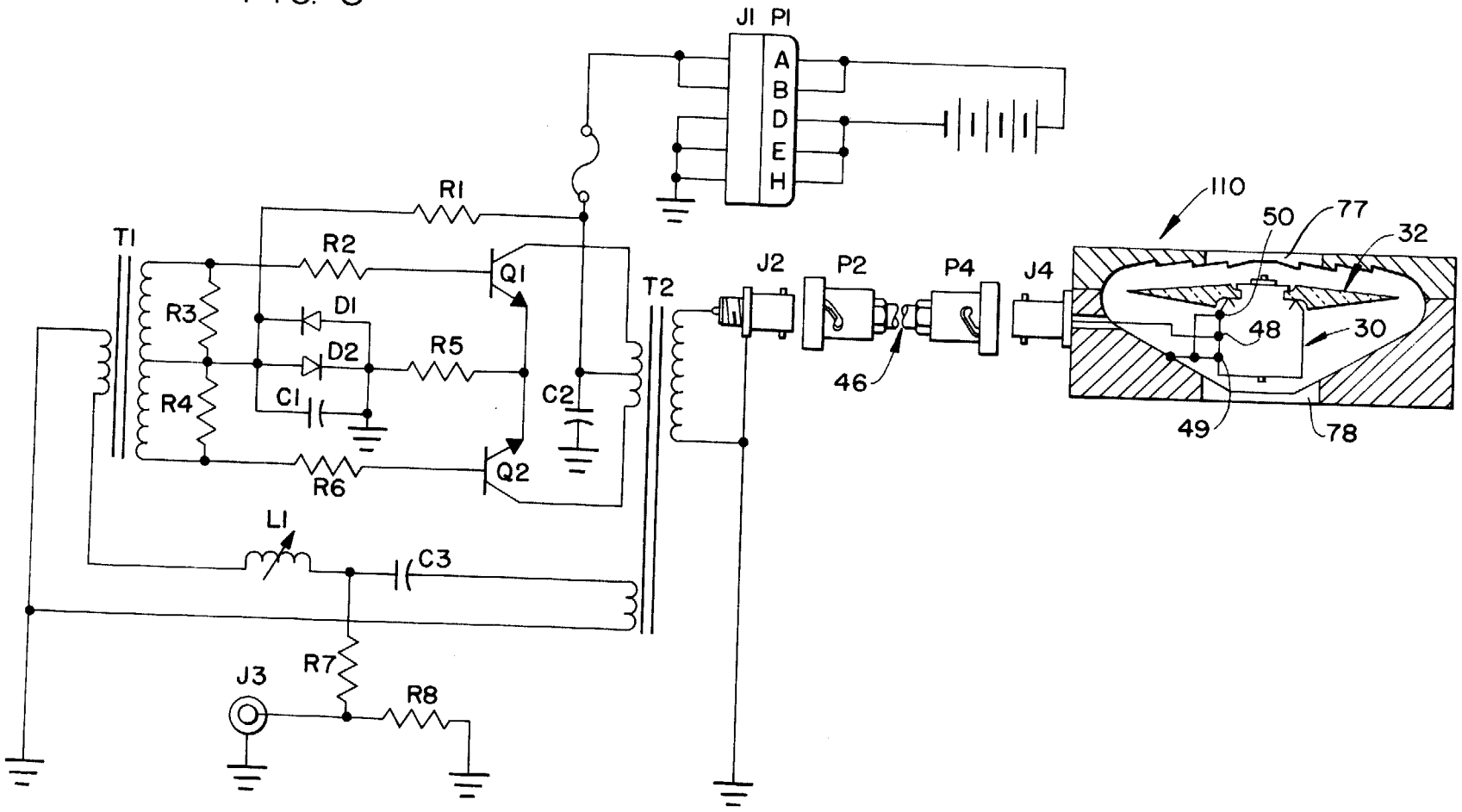
FIG. 3 is a part diagrammatical, part schematical, part cross-sectional illustration of circuitry and apparatus made in accordance with the present invention.

In FIG. 3 there is disclosed circuit means by which the driver or exciter 30 of the atomizer apparatus 110 is actuated. The circuitry is provided with a coaxal cable 46 having standard connections affixed thereto so that proper current and voltage values may be imposed at electrical connection 48.

The circuit values of FIG. 3 are as follows:

| | | | |
|---|---|---|---|
| R1 | 220 ohms | Q1 | 2N503B |
| R2 | 2 | Q2 | 2N503B |
| R3 | 10 | D1 | 1N4001 |
| R4 | 10 | D2 | 1N1120 |
| R5 | 0.1 | | |
| R6 | 2 | C1 | 4.7 μf |
| R7 | 1 meg | C2 | 200 μf |
| R8 | 10 K | C3 | .004 μf |

Figure 6:
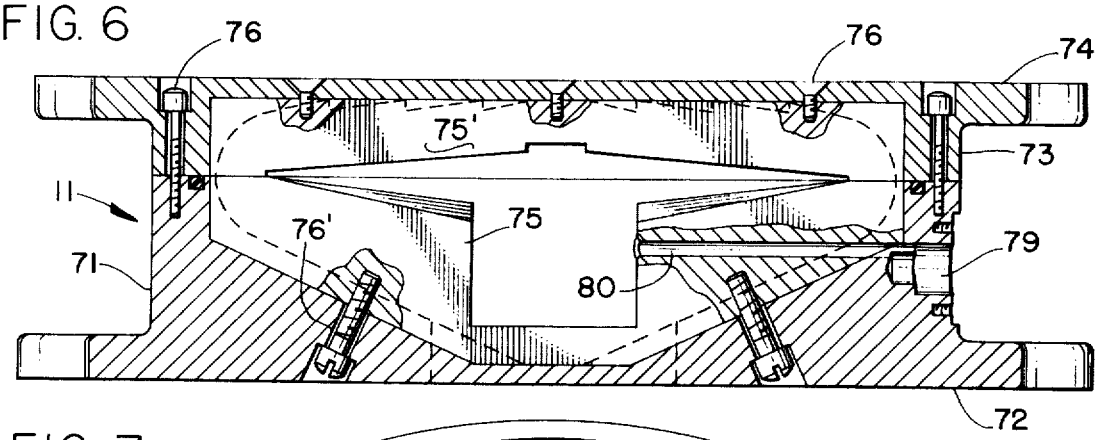
FIG. 6 is a cross-sectional view taken along line 6—6 of FIG. 4.
Figure 7:
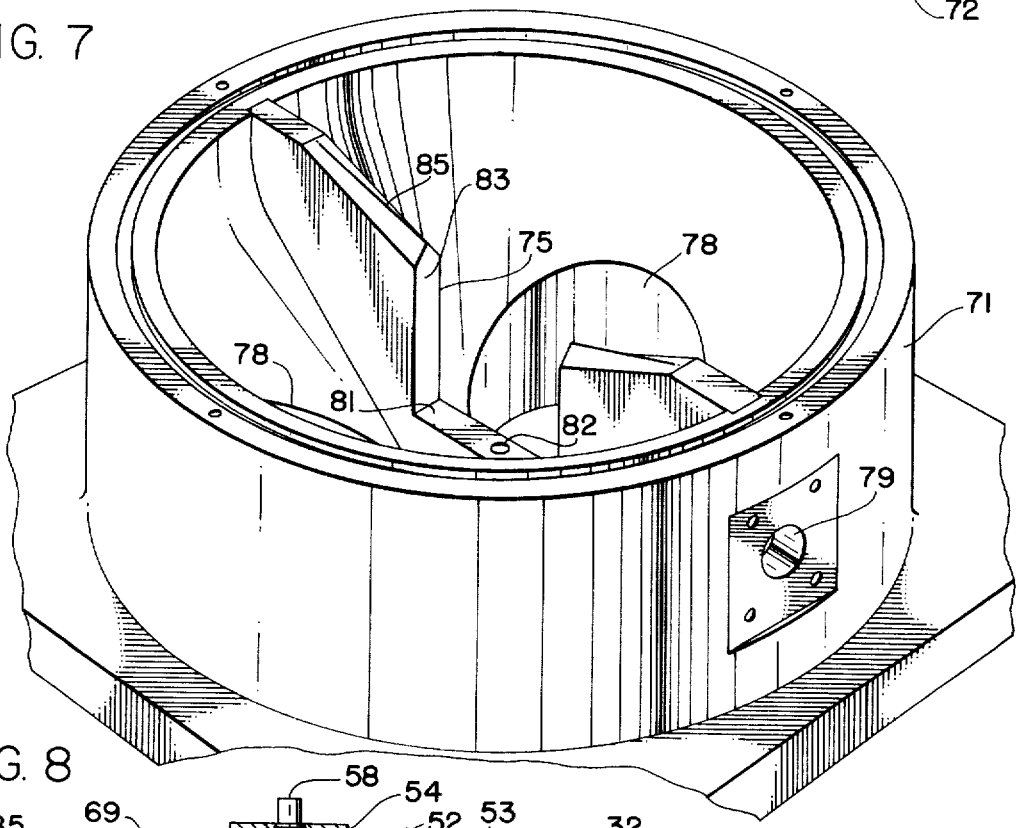
FIG. 7 is a perspective view of part of the apparatus disclosed in the foregoing figures.
Figure 8:
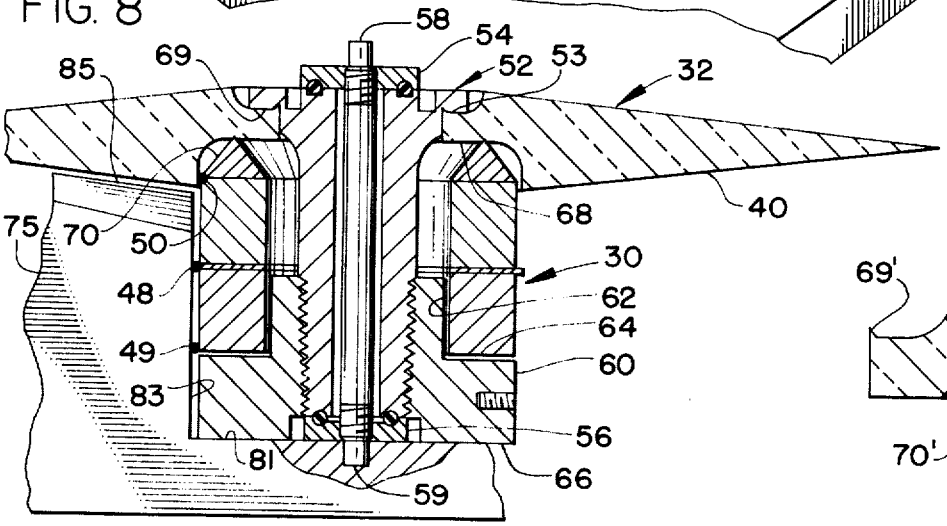
FIG. 8 is a fragmentary, part cross-sectional view of a more specific form of the invention; and, FIG. 9 is a fragmentary, enlarged view of part of the apparatus disclosed in FIG. 8.

Looking now to the specific embodiment of the invention disclosed in FIGS. 4–9, the before mentioned disk 32 is seen to be mounted to the exciter or driver 30 in a manner which provides a maximum cross-sectional area of the disk for a specific cross-sectional working area, while at the same time the height of the apparatus is at a minimum. As seen in FIGS. 3 and 8, the exciter comprises spaced cylindrical crystals, as for example two piezo electric crystals joined together by a metal shim to which the before mentioned conductor 48 is connected. The opposed ends of the crystal are electrically grounded at 49 and 50.

As best seen in FIG. 8, an elongated axially aligned load bolt 52 is provided with the illustrated shoulder 53 for being centrally positioned in a concentric manner respective to the apertured disk. The load bolt has an axial aligned longitudinally extending passageway, the ends of which are closed by means of suspension caps 54 and 56. The opposed caps are insulated from direct metallic contact with the ends of the load bolt by means of the illustrated o-rings. A tension bolt, or suspension rod, threadedly engages each of the suspension caps with opposed marginal end portions 58 and 59 of the rod freely protruding away from the assembly for purposes which will be better appreciated later on.

Locking ring 60 has a reduced diameter portion 62 formed by a shoulder 64, thereby leaving a face 66 disposed in opposition to face 52 of the load bolt.

Figure 9:
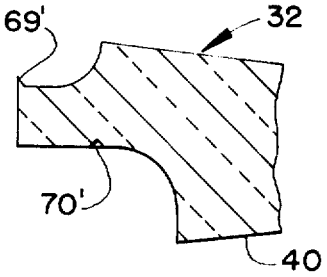

An interior marginal circumferentially extending portion near the apertured disk is reduced in thickness for engagement with the complementary annular shoulder of the load bolt so that opposed faces 68 and 69 of the reduced portion of the disk are compressed between a load ring 70 and the load bolt. The annular load ring and the annular shoulder of the load bolt are each concentrically arranged in spaced relationship relative to one another with the diameter of the bearing pressures being unequal respective to one another, thereby placing an annular ring of stress upon opposed surfaces of the disk. As seen in FIG. 9, an annular outwardly directed upset 69' is directed against the load bolt while an annular 30° groove 70' receives the apex of the load ring therein.

Figure 4:
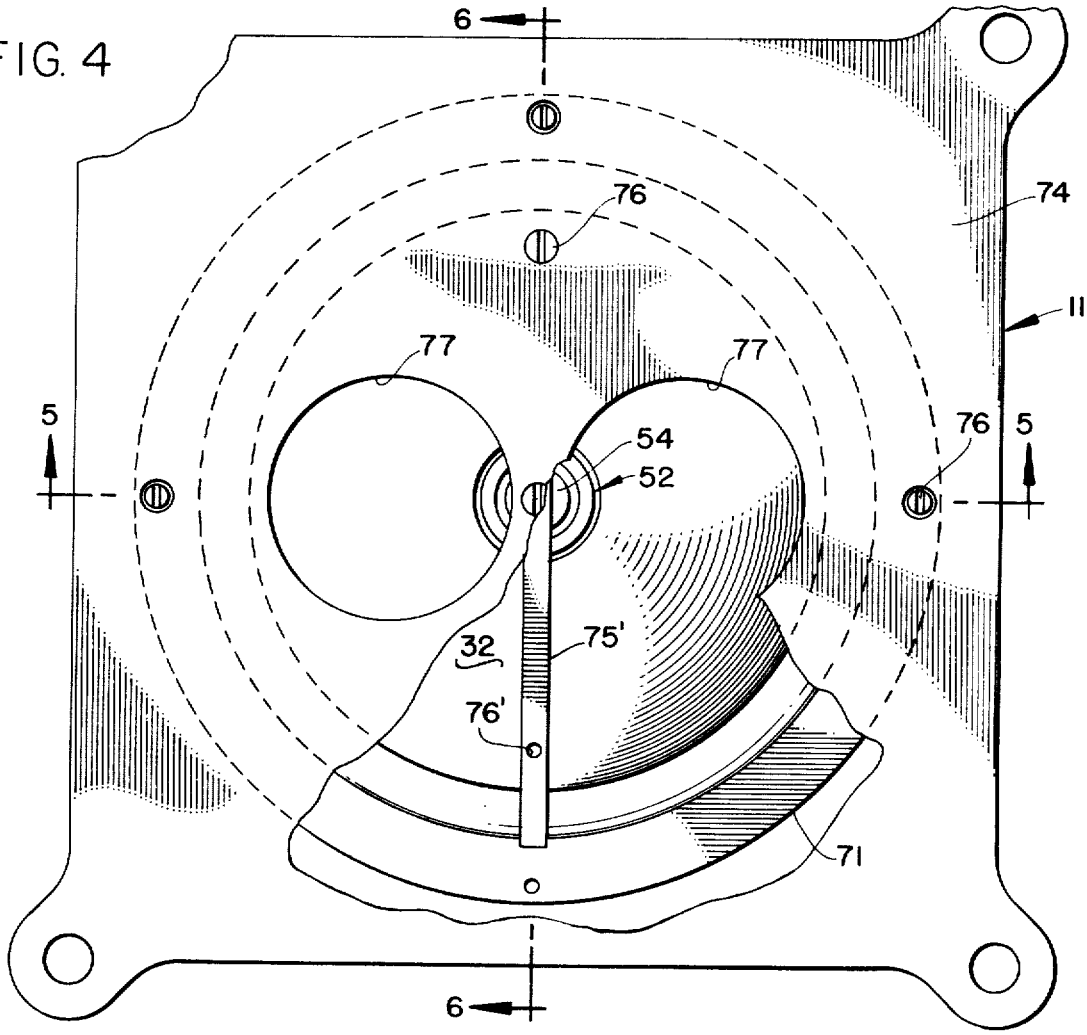
FIG. 4 is an enlarged, part cross-sectional top plan view of atomizer apparatus made in accordance with the present invention, with some parts being broken away therefrom so as to disclose the interior thereof.
Figure 5:
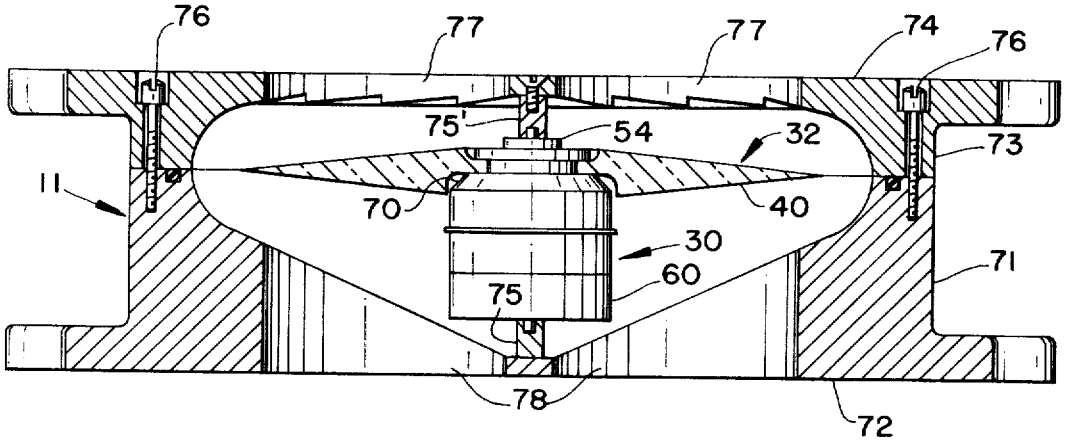
FIG. 5 is a part cross-sectional view taken along line 5—5 of FIG. 4.

As seen in the illustration of FIGS. 4 and 5 in conjunction with FIGS. 6 and 7, the before mentioned housing is comprised of a lower portion 71 having an outwardly directed face 72 formed thereon, and an upper portion 73 having an outwardly directed face 74 formed thereon, with the portions 71, 73 being held in mated relationship along the indicated interface by several radially spaced bolts 76.

Apertures 77 and 78 form a portion of the inlet and outlet flow passageways for flow of fuel and air through the atomizer apparatus. Vertically disposed plate members 75 and 75' are fitted into a complementary vertical groove formed into a marginal interior wall portion of the housing to provide separators for support of the atomizer disk and driver. As best seen in FIG. 6, counterbore 79 communicates with passageway 80 to form means by which an electric current carrying conductor can be connected at 48, 49, and 50.

OPERATION

In operation, the apparatus of the present invention is installed by merely unbolting the flanged interface between the carburetor and intake manifold of an internal combustion engine, and interposing the atomizer assembly of the present invention therebetween in the illustrated manner of FIG. 1. The circuitry disclosed in FIG. 3 is conveniently mounted within a suitable housing and located wherever there is adequate space within the vehicle.

When the engine is started, the metallic parts of the combustion fuel and air intake system are cold and therefore an accumulation of excess fuel in the intake system would ordinarily result, because the temperature is inadequate to achieve proper vaporization of the fuel with ordinary techniques. With the present invention, however, the large droplets that ordinarily collect within the system instead are collected on the resonanting disk. Hence, the vibrating disk which is driven by the piezo-electric or feromagnetic crystals atomizes the fuel impinging thereon and reintroduces it as a vapor or mist into the airstream.

Atomization is accomplished by transmitting the vibrational energy of the disk into the film of liquid collected on the surface of the disk. Droplets of fuel separate from the liquid surface on the disk and are pushed outward into the air stream by the sonic pressure created by the vibrating disk. The mean droplet size generated by the apparatus is dependent upon the excitational frequency and the physical properties of the liquid fuel itself.

In FIG. 2, for example, small droplets of fuel admix with air and flow about the disk at 38, while larger and heavier droplets of fuel impinge upon the upstream side 32 thereof. Hence, the velocity component of the fuel forces the large droplets to impinge upon the disk where the vibrational energy instantaneously reverses the direction of travel of the droplet and at the same time further reduces its size so that the droplet is broken up and shot back upstream where it admixes with air and ultimately flows about the disk at 38. Hence, large droplets of fuel impinge upon the disk while fuel which is properly atomized admixes with the air and flows about the periphery 34 of the disk.

Vibrational energy from the piezo-electric crystal causes a variable compressive force to be exerted about the opposed annular areas 69', 70' as best seen in FIG. 9. As the driver exerts a force between these two locations, the disk tends to pivot or flex at positions 69', 70', thereby setting up a vibrational mode in the disk. The transmission of the vibrational energy into the disk attains a maximum when the frequency is at the system resonance, thereby providing the most efficient atomization. This expedient is attained by tuning the coil L1 for maximum voltage effected at J3. The preferred embodiment of FIG. 3 operates on 6–15 vdc and consumes 10–30 watts total power over a wide range of ambient temperatures.

The circuitry of FIG. 3 includes a push-pull power amplifier comprised of transformers T1 and T2 and transistors Q1 and Q2, along with the associated biasing resistors. The circuit has a series tuned feedback through C3 and L1 which is tuned to the optimum natural frequency of the atomizer.

The atomizer has a high impedience at the optimum selected resonance and therefore it loads the transformer T2 at its resonant frequency so that the circuit is forced to oscillate at the same frequency as the atomizer.

The atomizer is capable of oscillating in several different modes, only one of which is optimum for the purpose of the present invention. Accordingly, the purpose of the series tuned feedback C3 and L1 is to prevent the system from oscillating in any of these undesired modes of operation.

The housing can be made of aluminum, steel, or high temperature resistant plastic. The disk is preferably made of metal. The exciter or driver is preferably a crystal or a metal which vibrates in response to being properly excited by an electrical current or a magnetic field.

The atomizer assembly of the present invention is uniquely housed in a manner to provide a flow path about the vibrating disk which does not seriously impede the air flow from the carburetor to the intake manifold.

As seen in FIGS. 7 and 8, the razor edge 85 is slightly spaced from the face 40 of disk 32 so that fluid will not build up therebetween and cushion or dampen the oscillatory motion of the disk. The razor edge greatly enhances the operation of the system in an unexpected manner. In FIG. 8, the load bolt and locking ring are tightened until the member 30 is compressed therebetween an optimum amount to cause the disk to vibrate at its preferred frequency of operation.

The present invention provides improved fuel atomization which in turn greatly enhances cold engine cranking. A leaner and shorter duration of choke setting as well as satisfactory cold drive is attained. The present invention enables proper combustion to be achieved while the engine is being warmed as well as more efficient combustion after equilibrium has been attained.

Significant reductions in unwanted exhaust emissions during the critical warm-up stage of operation of the vehicle is accomplished. It is unnecessary for an accumulation of excess fuel in the intake system to be present in order for the engine to start, and accordingly, dumping of raw fuel into the exhaust treatment system is avoided with the present invention. Furthermore, the load on the exhaust treatment system after starting is substantially reduced because of permissible leaner air/fuel settings. The increased efficiency achieved by the more uniform distribution of fuel within the air enables a leaner mixture to be employed, which in turn significantly reduces the total exhaust output per unit of power, as well as lowering obnoxious emissions therefrom because of the increased efficiency of the combustion process.

I claim:

1. In combination with an internal combustion engine having an intake manifold flow connected to a carburetor, a post carburetor atomizer apparatus interposed between said carburetor and manifold;

said atomizer apparatus comprising a housing having an inlet and an outlet, an exciter, an atomizer plate assembly; means including circuitry connected to said exciter for causing excitation thereof;

said housing comprising upper and lower cavity forming members having said upper and lower separators attached thereto; said separators having adjacent sharp edge portions which are spaced from said plate assembly when said upper and lower portions of said housing are mated so that said atomizer plate assembly is enclosed within said housing such that an annulus is formed about said plate assembly to cause large droplets of fuel to be forced to impinge upon said plate assembly and the droplets subsequently atomized by the vibrating action thereof; said plate assembly being apertured and provided with opposed faces;

a load bolt means having a shoulder formed thereon for engagement with one said face, a locking ring, a load ring, said exciter being compressed between said locking ring and load ring, a marginal circumferentially extending annular area of said plate assembly being compressed between said load ring and said load bolt means;

an annular area formed on one face of said plate assembly, the last said area being smaller in diameter with respect to the annular area contacted by said load ring, each said annular area being concentrically arranged respective to one another and placed in compression by said load bolt means and said load ring;

whereby, said exciter imparts vibration into said locking and load rings to thereby compress the opposed faces of the plate assembly so that the plate assembly vibrates in a flexural mode.

2. The combination of claim 1 wherein an axial passageway is formed between said inlet and outlet, said annulus being formed between said housing and the outer periphery of said plate, said plate being arranged normally to the axial passageway so that flow of air and fuel must change direction as it flows from the inlet to the outlet, thereby causing droplets of fuel to impinge upon said plate.

3. The combination of claim 1 wherein said exciter is a piezoelectric crystal and said plate assembly is arranged with respect to said crystal so that it vibrates in a flexural mode at the system resonance to thereby provide the most efficient atomization.

4. Ultrasonic post carburetor atomizer apparatus for reducing the droplet size of a liquid dispersed within a gaseous medium comprising:

a chamber forming housing made of upper and lower cavity forming members, said members having upper and lower separators attached thereto, said housing having an inlet and an outlet; an apertured vibrating element having opposed faces; driver means for causing said vibrating element to vibrate at the resonant frequency of the system;

said separators having adjacent sharp edge portions which are spaced from the opposed faces of said vibrating element when said upper and lower portions of said housing are mated;

means including a load bolt having a shoulder formed thereon for engagement with one said face, a locking ring, a load ring, said driver means being compressed between said locking ring and load ring, a marginal circumferentially extending area of said driver means being compressed between said load ring and said load bolt;

an annular area formed on one face of said vibrating element which is smaller in diameter with respect to the annular area contacted by said load ring, each said annular area being concentrically arranged relative to one another and placed in compression by said load bolt and ring;

whereby, said driver means imparts vibration into said locking and load rings to thereby compress the opposed faces of the vibrating element so that it vibrates in a flexural mode.

5. The apparatus of claim 4, driver means includes circuit means comprised of a power amplifier having a series connected capacitor and inductance which form a tuned feedback system;

said inductance and capacitor being tuned to cause said vibrating element to vibrate at its most optimum frequency, thereby forcing said driver and vibrating element to oscillate at the optimum frequency of the system.

6. Ultrasonic post carburetor atomizer apparatus for reducing the droplet size of a liquid dispersed within a gaseous medium comprising:

a chamber forming housing having an inlet and an outlet, a vibrating element having opposed faces and arranged whereby it can vibrate in a flexural mode, driver means for causing said vibrating element to vibrate at the resonant frequency of the system;

means including upper and lower separators for suspending said driver and said vibrating element within said housing;

said housing comprising upper and lower cavity forming members having said upper and lower separators attached thereto;

said separators having adjacent sharp edge portions which are spaced from opposed faces of said vibrating element when said upper and lower portions of said housing are mated;

an annular area formed on said opposed faces of said vibrating element, means by which each said annular area is compressed against said driver means so that variable compressive forces cause the vibrating element to vibrate in a flexural mode.

7. The apparatus defined in claim 6, wherein there is further included a load bolt and a load ring; said load bolt contacts one said annular area formed on one face of said vibrating element while the remaining annular area is contacted by said load ring, each said annular area being concentrically arranged relative to one another and placed in compression by said load bolt and ring.

8. The apparatus of claim 6, wherein said driver means includes circuitry connected thereto, said circuitry is a push-pull transistorized power amplifier having a series connected capacitor and inductance which form a series tuned feedback system which is tuned to the optimum resonant frequency of the exciter, thereby forcing said exciter to cause the vibrating element to oscillate at the optimum frequency of the atomizer system.

9. The atomizer apparatus of claim 6 wherein said vibrating element is in the form of a disk arranged normal respective to the flow path, said driver means being an electrical responsive means which vibrates in response to electrical energy being connected thereto, circuit means connected to said drive means for providing said electrical energy.

10. The combination of claim 6, wherein said driver means includes means forming circuitry, said circuitry is a push-pull transistorized power amplifier having a series connected capacitor and inductance which form a series tuned feedback system which is tuned to the optimum resonant frequency of the exciter, thereby forcing said exciter to cause the vibrating element to oscillate at the optimum frequency of the atomizer system.

* * * * *

UNITED STATES PATENT OFFICE

CERTIFICATE OF CORRECTION

PATENT NO. : 3,955,545

DATED : May 11, 1976

INVENTOR(S) : Jack C. Priegel

It is certified that error appears in the above-identified patent and that said Letters Patent are hereby corrected as shown below:

Title page, line 7 of the Abstract, after "apparatus" insert --includes --; and delete "driver".

Line 8, substitute --driver-- for "driven".

Column 7, line 12, insert --wherein said-- after "Claim 4,".

Signed and Sealed this

Fifth Day of October 1976

[SEAL]

*Attest:*

RUTH C. MASON
*Attesting Officer*

C. MARSHALL DANN
*Commissioner of Patents and Trademarks*